US008117851B2

(12) United States Patent
Sugawara

(10) Patent No.: US 8,117,851 B2
(45) Date of Patent: Feb. 21, 2012

(54) LIQUIFIED GAS SUPPLY SYSTEM AND METHOD THEREOF

(75) Inventor: Ichiro Sugawara, Yamagata (JP)

(73) Assignee: Renesas Electronics Corporation, Kanagawa (JP)

( * ) Notice: Subject to any disclaimer, the term of this patent is extended or adjusted under 35 U.S.C. 154(b) by 781 days.

(21) Appl. No.: 12/117,914

(22) Filed: May 9, 2008

(65) Prior Publication Data

US 2008/0282709 A1 Nov. 20, 2008

(30) Foreign Application Priority Data

May 17, 2007 (JP) ..... 2007-131670

(51) Int. Cl.
*F17C 7/04* (2006.01)
*F17C 13/02* (2006.01)
*F17C 9/02* (2006.01)
*F25B 19/00* (2006.01)

(52) U.S. Cl. ..... 62/48.1; 62/49.1; 62/51.1; 62/50.2

(58) Field of Classification Search ..... 62/657, 62/159, 48.1–50.2; 165/301, 302
See application file for complete search history.

(56) References Cited

U.S. PATENT DOCUMENTS

| | | | | |
|---|---|---|---|---|
| 2,725,722 | A * | 12/1955 | Ahlstrand et al. | 62/50.2 |
| 5,454,408 | A * | 10/1995 | DiBella et al. | 141/197 |
| 5,894,742 | A * | 4/1999 | Friedt | 62/50.2 |
| 6,199,384 | B1 * | 3/2001 | Udischas et al. | 62/48.1 |
| 6,263,675 | B1 * | 7/2001 | Hansen et al. | 60/649 |
| 6,614,009 | B2 * | 9/2003 | Gershtein et al. | 219/486 |
| 7,614,613 | B2 * | 11/2009 | Shield | 261/26 |
| 2002/0124575 | A1 * | 9/2002 | Pant et al. | 62/50.1 |
| 2008/0264072 | A1 * | 10/2008 | Miyoshi et al. | 62/48.1 |
| 2010/0025031 | A1 * | 2/2010 | Liu et al. | 165/287 |

FOREIGN PATENT DOCUMENTS

| | | |
|---|---|---|
| JP | 11-226386 | 8/1999 |
| JP | 2003-028395 | 1/2003 |
| JP | 2006-161937 | 6/2006 |

* cited by examiner

*Primary Examiner* — Frantz Jules
*Assistant Examiner* — Keith Raymond
(74) *Attorney, Agent, or Firm* — Young & Thompson

(57) ABSTRACT

A liquefied gas supply system and method can supply the liquefied gas in a plurality of liquefied gas containers uniformly to supply huge amount of gas constantly. A liquefied gas supply system comprises a plurality of liquefied gas containers 1, a detector 2 installed in each of the containers 1 to detect a volume of liquefied gas contained in each of the containers 1, a heating device 3 installed on each of the container 1 and a control device 7 to process information obtained by each of the detectors 2 and control each of the heating devices 3. The control device 7 controls each of the heating devices 3 based on a value obtained by overall processing of the information obtained by each of the detectors 2.

8 Claims, 10 Drawing Sheets

21... CYLINDER
22...GAS SUPPLY PIPING
23...PRESSURE REGULATOR
24...BUFFER TANK
25...GAS SUPPLY PIPING
L...LIQUEFIED GAS
L...LIQUEFIED GAS
G...VAPORIZED GAS

100 LIQUEFIED GAS CYLINDER
101 1ST HEATING MEANS
102 2ND HEATING MEANS
103 3RD HEATING MEANS
104 MIXED GAS FLOW DETECTION MEANS
105 1ST PIPING
106 2ND PIPING
111 1ST ELECTRIC SUPPLY
112 2ND ELECTRIC SUPPLY
113 3RD ELECTRIC SUPPLY
114 VALVE CONTROLLER
115 CENTRAL CONTROLLER
116 CONTROL LINES
120 $N_2$ CYLINDER
121 DELETED GAS PIPING
131 ~140 SEPARATION VALVES
141 ~150 DEMANDS

LIQUIFIED GAS SUPPLY SYSTEM AND METHOD THEREOF

REFERENCE TO RELATED APPLICATION

This application is based upon and claims the benefit of the priority of Japanese patent application No. 2007-131670, filed on May 17, 2007, the disclosure of which is incorporated herein in its entirety by reference thereto.

FIELD OF THE INVENTION

This invention relates to a liquefied gas supply system and method by controlling heating of a plurality of liquefied gas containers.

BACKGROUND OF THE INVENTION

When a large volume of liquefied gas whose vapor pressure is low and therefore vaporization volume is low at an ordinary temperature is necessary, methods to increase vaporization surface area or to raise the gas temperature are used. And increasing a diameter of a container of the gas, parallel connection of containers having a standard volume or heating the container is effective to realize the methods. Therefore, a system has been developed to supply huge volume of the gas constantly by the parallel connection of the containers having a standard volume which is easily available, heating the gas container or combination of them.

FIG. 7 shows an example 1 of conventional controlling method of a liquefied gas supply system (Patent Document 1). The control method of liquefied gas supply system is, as shown in FIG. 7, observing a remained volume of the liquefied gas in each cylinder by a volume indicator installed in each cylinder. And when the remaining volume of the gas decreased below a predetermined value, the supply is shut off by closing a controlled closing valve. The gas in each cylinder can be consumed to the minimum volume even when a decreasing speed of the gas in each cylinder is different in the system. However, a heating means to heat the gas in the cylinder is not installed.

FIG. 8 shows an example 2 of conventional controlling method of a liquefied gas supply system (Patent Document 2). The supply system and method of liquefied gas comprises a plurality of liquefied gas cylinders 21 and a gas reservoir (buffer tank) 24 before a pressure controlling pot 23 connected by gas piping lines 22, 25. The vaporized gas at normal temperature is introduced into the buffer tank through the piping and temporarily storaged there. The buffer tank plays a role as a temporary storage tank and when a sudden change of the amount of the gas consumption occurred, the gas in the buffer tank is supplied from the pressure controlling pot through the piping and can follow the consumption of the gas. However, a heating means to heat the gas in the cylinder is not installed in this example 2. Furthermore, there is no description for a detection means of remaining volume of the liquefied gas in the cylinder.

FIG. 9 shows an example 3 of a conventional supply method of liquefied gas (Patent Document 3). As is shown in FIG. 9, the liquefied gas supplying method comprises liquefied gas cylinder 100, a first piping 105, a second piping 106 and a gas-flow detection means 104. And the liquefied gas cylinder 100, the first piping 105 and the second piping 106 are heated by a first heating means 101, a second heating means 102 and a third heating means 103, respectively which are controlled in response to a measured value obtained by the gas-flow detection means 104. Or the heating is controlled in response to the number of opened valve among a plurality of valves 131 to 140 provided after the second piping 106 instead of using the measured value obtained by the gas-flow detection means 104. This heating method has a condition that at least one valve among the valves should be opened and the gas is supplied constantly. However, the method disclosed in the Patent Document 3 uses only one liquefied gas cylinder 100 and not a plurality of cylinders. Nor any detection means of the remained volume in the liquefied gas cylinder is disclosed.

FIG. 10 shows an example 4 (related art) of a liquefied gas supply system using a plurality of gas containers. As is shown in FIG. 10, the system comprises a plurality of liquefied gas containers having a standard size and arranged in parallel, and each of the liquefied gas containers is heated separately and remained gas volume in each of the gas container is measured by a measurement device such as a weight scale. A heat controller system as heating means 3-1 to 3-n , heat measurement sensors 4-1 to 4-n , temperature controllers 5-1 to 5-n and heat output units 6-1 to 6-n and a measurement system of the liquefied gas volume in the containers as scales 2-1 to 2-n are installed and controlled separately.

[Patent Document 1]

JP Patent Kokai Publication No. JP-H11-226386A

[Patent Document 2]

JP Patent Kokai Publication No. JP-2003-28395A

[Patent Document 3]

JP Patent Kokai Publication No. JP-2006-161937A

SUMMARY OF THE DISCLOSURE

The entire disclosures of Patent Documents 1 to 3 are incorporated herein by reference thereto. The following analyses are given by the present invention.

The controlling method of liquefied gas supply system described in FIG. 7 is premised on the fact that there is an unbalanced decreasing of liquefied gas volume in the cylinders and when a cylinder whose gas volume remains in the cylinder becomes less than the predetermined value, the cylinder is closed sequentially. Therefore, as the number of the closed cylinders increases, vaporization surface area decreases and the vaporization surface area finally becomes too small for keeping the necessary vaporization capacity by a small number of cylinders. In addition, the problem is emphasized when the number of the cylinders becomes small because only the vaporization at the normal temperature is expected since the system has no heating means.

The supply system and method of liquefied gas shown in FIG. 8 has a problem that a large volume of buffer tank 24 is necessary and that when a temperature of the buffer tank is lower than a temperature of the cylinders 21, the vaporized gas in the buffer tank is liquefied again. This means that the liquid is simply transported from the cylinders 21 to the buffer tank 4 and the system simply supply the gas from one big tank which has a sufficient volume to follow the sudden change of the consumption of the gas. Therefore, an environmental condition of the cylinders 21 and the buffer tank 24 is necessary that the temperature of the buffer tank 24 should be maintained higher than the temperature of the cylinders 21 to prevent re-condensation of the gas in the buffer tank 24. Furthermore, when the system contains a plurality of cylinders and temperatures between cylinders are different, the liquefied gas in the cylinders of higher temperature is transported precedently to the buffer tank 24 by re-condensation due to the difference of the vapor pressures between cylinders. Therefore, the volume of remaining gas in each cylinder varies greatly when the cylinders are changed to new ones at the same time unless the system has no means explained in the example 1 (FIG. 7).

The conventional liquefied gas supplying method shown in FIG. 9 controls each heating means 101, 102 and 103 to keep vaporization heat of the gas for the required supply. However, there is a limitation of heating temperature to increase the vaporization capacity only by the heating means. And even when a plurality of the cylinders 100 are used to increase the vaporization surface area and heated by the heating means 101, a uniform evaporation between the cylinders cannot be realized because the temperatures of the liquefied gas itself in the cylinders are not controlled even though every heating means is controlled and an unbalanced consumption of the gas in the cylinder, which has a higher temperature and a higher vapor pressure, is observed.

The liquefied gas supplying system having a plurality of gas cylinders as shown in FIG. 10 has a temperature controller using a measured temperature of an outer surface of the cylinder for each cylinder. However, an unbalanced consumption of the gas or transportation (re-condensation) of the liquefied gas between cylinders still occurs even though such a control is executed.

According to the inventor's findings, the liquefied gas is transported between containers by a very small difference of the temperatures such as an influence of a flow of the air in a room where the containers are placed, for example. Therefore, a control of heating using the temperature of the liquefied gas itself is necessary to prevent the transportation of the gas; however, it is difficult to measure the temperature of the liquefied gas itself.

As explained above, there are two problems in the conventional systems or methods. One of them is the unbalanced consumption of the liquefied gas when supplied, that is, when a plurality of liquefied gas containers are used in parallel, only the gas in the container whose vapor pressure is higher is consumed due to a temperature difference between containers irrespective of the provision of the heating means. The other problem is the transportation of the liquefied gas between containers, that is, when the gas supply is stopped, the liquefied gas is transported from a container whose vapor pressure is higher to a container whose vapor pressure is lower through connection piping.

It is an object of the present invention to provide a supply system and supply method of liquefied gas which can supply the liquefied gas stored in a plurality of liquefied gas containers uniformly up to a final stage in order to supply a huge amount of gas stably.

According to the present invention, the problem is solved by controlling each heating device based on a value obtained by an overall processing of the information obtained from all (each of) the containers at every instance, without recourse to the controlling based on a predetermined value.

According to a first aspect of the present invention, there is provided a liquefied gas supply system comprising: a plurality of liquefied gas containers, a detector installed in each of the containers that detects a volume of liquefied gas contained in each of the container, a heating device installed on each of the container, and a control device that processes information obtained by each of the detectors and controls each of the heating devices. The control device controls each of the heating device based on a value obtained by a comprehensive (i.e., overall) processing of the information obtained by all of the detectors.

A measurement item can be a weight or a volume (bulk) of the liquefied gas in the container. Also a liquid level of the liquefied gas may be used. Any known measurement method can be used for the measurement.

As a second aspect of the liquefied gas supply system of the present invention, each detector is a weight detector of the liquefied gas.

As a third aspect of the liquefied gas supply system of the present invention, the value is an average weight obtained by averaging all weights of the liquefied gas in the containers, and the control device controls each of the heating devices so that a difference between a weight obtained by a detector of a container concerned and an average weight becomes smaller than a predetermined value.

As a fourth aspect of the liquefied gas supply system of the present invention, each of the detectors is a level detector of the liquefied gas.

As a fifth aspect of the liquefied gas supply system of the present invention, the value is an average level obtained by averaging all levels of the liquefied gas in the containers, and the control device controls each of the heating devices so that a difference between a level obtained by a detector of a container concerned and the average level becomes smaller than a predetermined value.

According to a sixth aspect of the present invention, the liquefied gas supply system comprises a connection shut off valve to shut off connection lines between the containers coupled with a closing valve to shut off supply of the gas.

According to a seventh aspect of the present invention there is provided a liquefied gas supply method to supply the gas from a plurality of liquefied gas containers. The method comprises: controlling each heating device installed on each of the liquefied gas containers using a processed information obtained from each detector installed on each of the liquefied gas containers to detect a volume of the liquefied gas in each of the liquefied gas containers. Each of the heating devices is controlled based on a value obtained by a comprehensive (i.e., overall) processing of information obtained from all of the detectors.

As an eighth aspect of the liquefied gas supply method of the present invention, each of the detectors is one of a weight detector and a level detector of the liquefied gas.

According to a ninth aspect of the present invention, there is provided a control device of a liquefied gas supply system to control each heating device installed on each liquefied gas container. The control device uses a processed information obtained from each detector installed on each of the liquefied gas containers to detect a volume of the liquefied gas in each of the liquefied gas containers. Each of the heating devices is controlled based on a value obtained by a comprehensive (i.e., overall) processing of information obtained from all of the detectors.

In a tenth aspect of the present invention, each of the detectors may be one of a weight detector and a level detector of the liquefied gas.

The meritorious effects of the present invention are summarized as follows. The liquefied gas in a plurality of liquefied gas containers is consumed uniformly by using the present invention. That is, a necessary vaporization capacity at a predetermined temperature can be maintained from the beginning of supply of the liquefied gas up to the end because all of the gas in the containers are consumed uniformly and a necessary vaporization surface area is maintained constant by keeping connections between all of the containers.

PREFERRED MODES OF THE INVENTION

A liquefied gas supply system and a temperature control method of the present invention are described using some exemplary embodiments in detail with reference to the figures.

EXAMPLE 1

Figure 1:
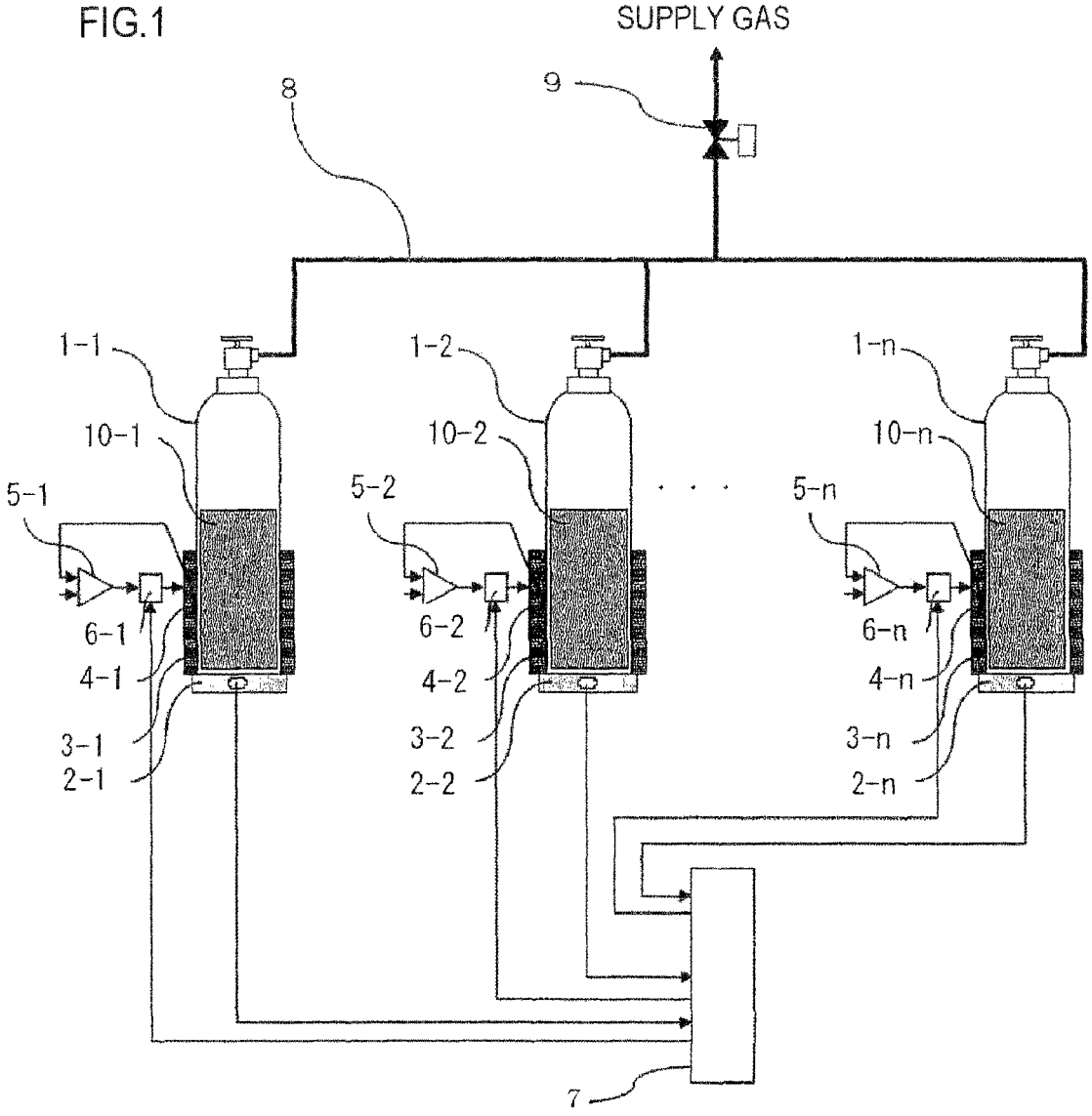
FIG. 1 shows a structure of an example 1 of the liquefied gas supply system of the present invention.

FIG. 1 shows a structure of an example 1 of the liquefied gas supply system of the present invention. The liquefied gas supply system of the present invention comprises a plurality (n) of containers 1-1 to 1-n , weight detectors 2-1 to 2-n, heaters 3-1 to 3-n, heat sensors 4-1 to 4-n, temperature controllers 5-1 to 5-n, heat output units 6-1 to 6-n, a processor/comparator of measured values 7, connection piping 8, a shut off valve 9 and liquefied gas 10-1 to 10-n in the containers. (The n-th element is denoted by a suffix n as "1-n ", for example.)

Each of the containers 1-1 to 1-n has the same size and capacity and each of the liquefied gas volume 10-1 to 10-n (in weight for this example 1) is known before setting in the system. All of the containers are connected each other by the connection piping 8 in parallel and collected toward the shut off valve 9.

Under this state, the volume (in weight for this example) in each of the containers is measured by the weight detectors 2-1 to 2-n continuously and the measured values are transmitted to the processor/comparator of measured values 7. And the heaters 3-1 to 3-n and the heat sensors 4-1 to 4-n are installed on containers 1-1 to 1-n, respectively. The required temperature computed by a known relation between temperature and vapor pressure of the liquefied gas is set in the temperature controllers 5-1 to 5-n and the processor/comparator of measured values 7 controls the temperature of the liquefied gas 10-1 to 10-n by the heaters 3-1 to 3-n via the heat output units 6-1 to 6-n by PID control. The processor/comparator of measured values 7 calculates the transmitted measured values, compares the measured value with the calculated value and outputs a stop signal when the result satisfied a condition. Thus the processor/comparator 7 compensates an output of the heat output units 6-1 to 6-n by interrupting heating control outputs outputted from the temperature controllers 5-1 to 5-n.

Figure 2:
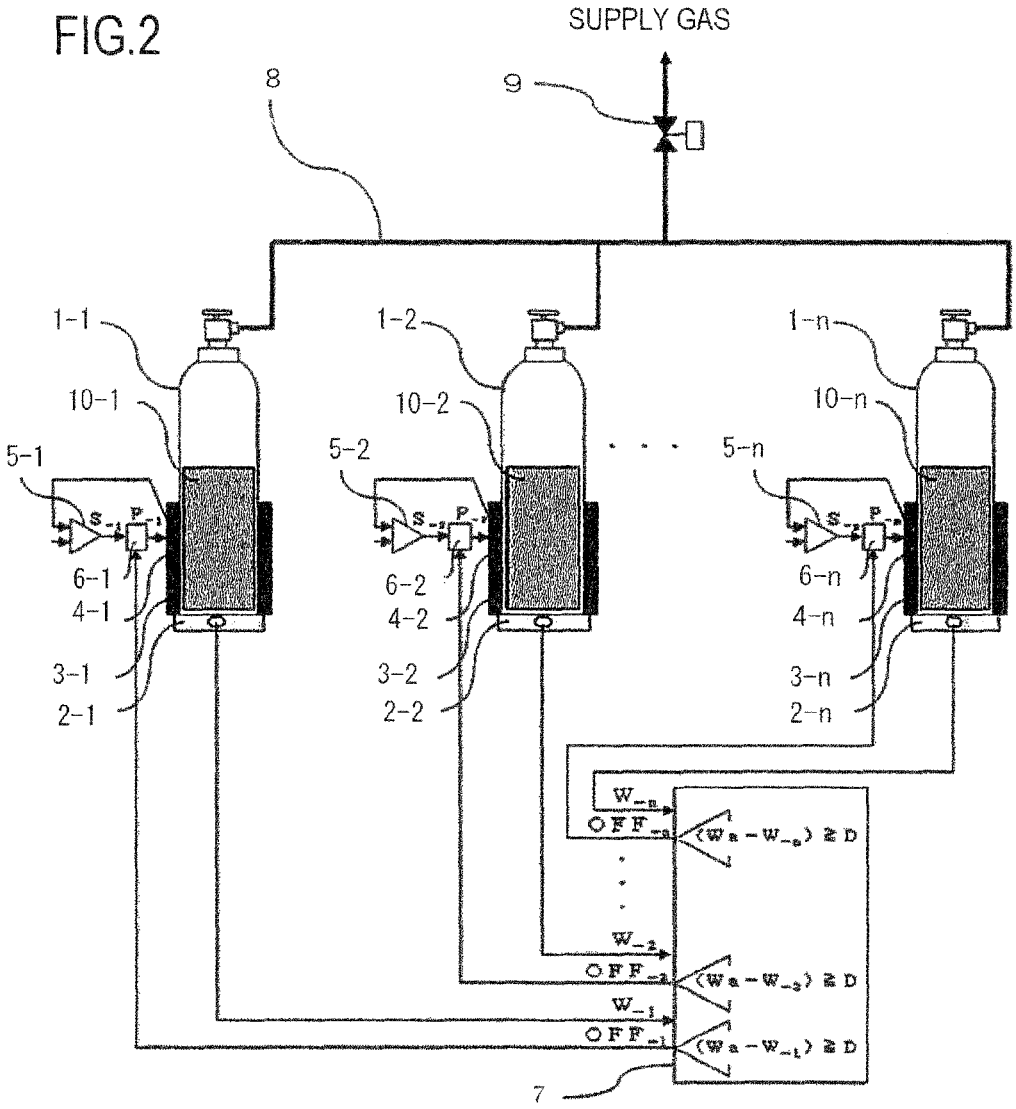
FIG. 2 shows an example of signals (data) processed by a processor/comparator of measured values of the present invention.
Figure 3:
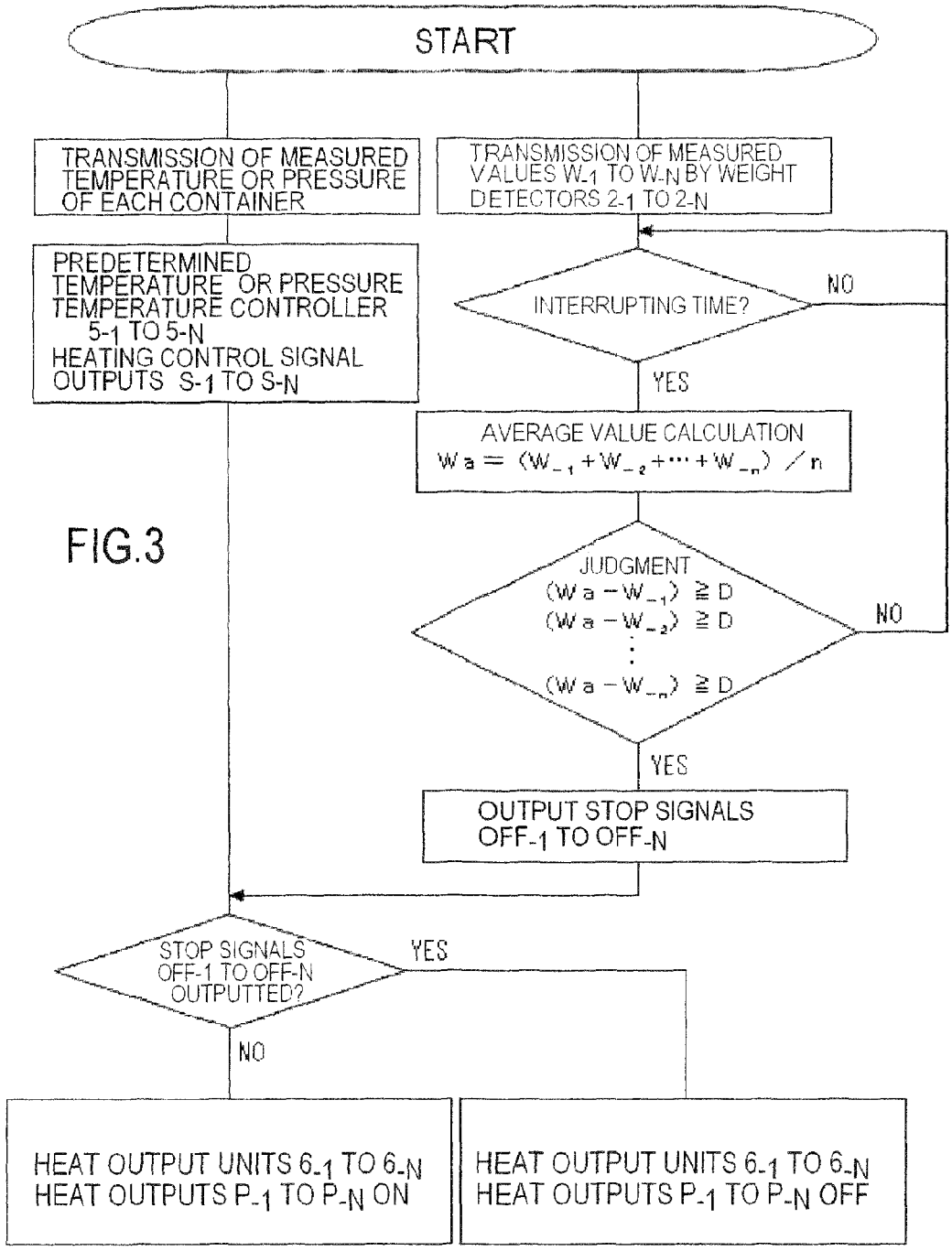
FIG. 3 is an example of a heating control flowchart of the liquefied gas supply system of the present invention.
Figure 4:
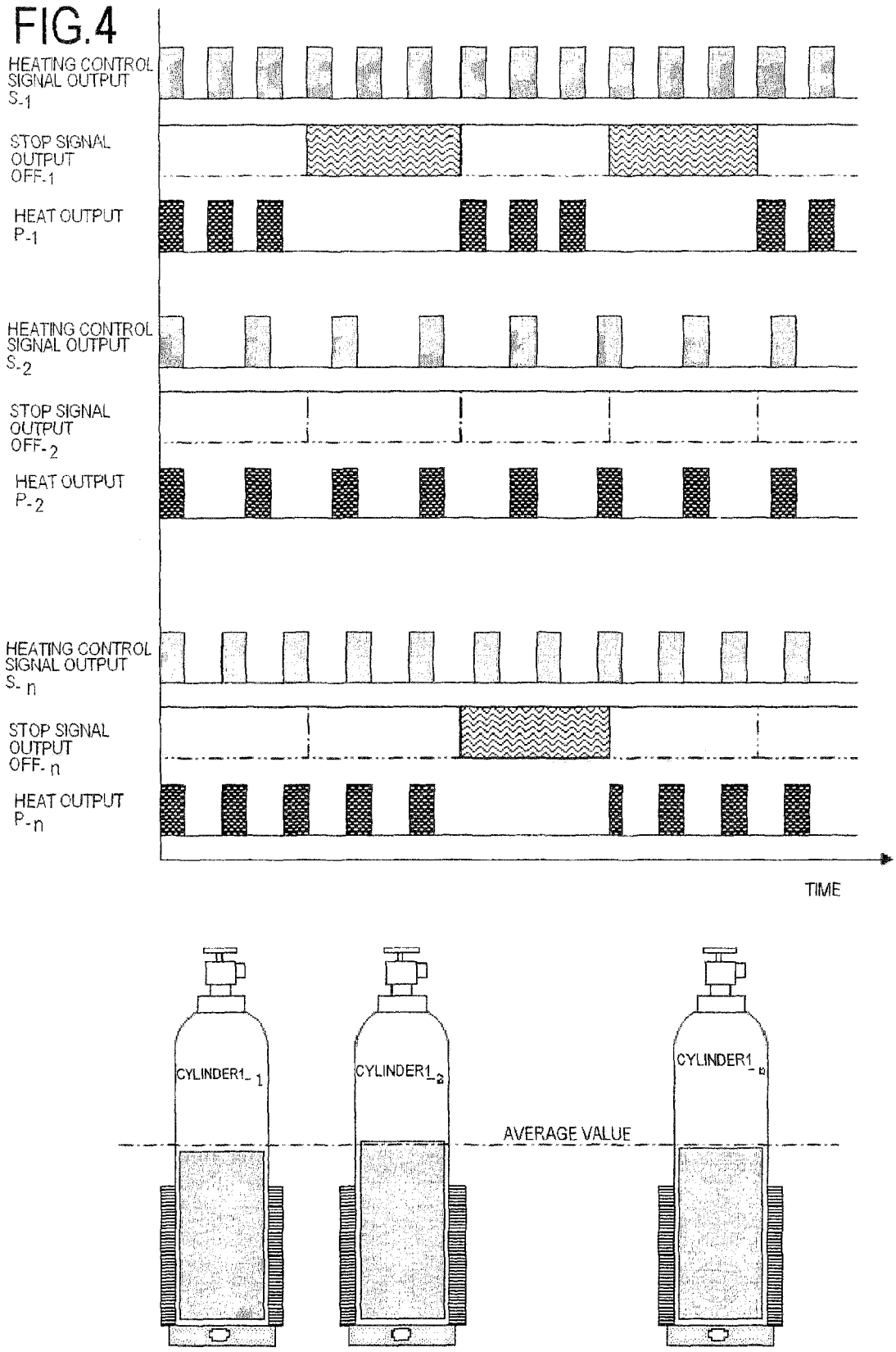
FIG. 4 shows an example of a relation between remaining gas volume and a timing chart of control signals for the liquefied gas supply system of the present invention.

FIGS. 2 to 4 are schematic drawings for illustrating a structure and an operation of an example 1 of the present invention and example 1 is explained using FIGS. 2 to 4.

In FIG. 2, W-1 to W-n denote the measured values obtained by the weight detectors 2-1 to 2-n, Wa is an average value of the measured values calculated by the processor/comparator 7, D is a predetermined value set in the processor/comparator 7 and OFF-1 to OFF-n are stop signals outputted by the processor/comparator 7 based on results of comparisons of the measured values W-1 to W-n with Wa. The signals processed in the processor/comparator 7 are shown in FIG. 2.

Also in FIG. 2, S-1 to S-n denote heating control signal outputs outputted from the temperature controllers 5-1 to 5-n and P-1 to P-n denote heat outputs outputted from the heat output units 6-1 to 6-n to the heaters 3-1 to 3-n.

FIG. 3 is an example of a heating control flowchart of the liquefied gas supply system of the present invention. The processor/comparator 7 obtains the measured values W-1 to W-n, calculates an average value Wa of the measured values W-1 to W-n and calculates differences between W-1 to W-n and Wa. Then the processor/comparator 7 compares the differences with D and if the differences are larger than D, the processor/comparator 7 produces the stop signals OFF-1 to OFF-n. The processor/comparator 7 interrupts the heating control signal outputs S-1 to S-n outputted to the heat output units 6-1 to 6-n from the temperature controllers 5-1 to 5-n and sets the stop signals OFF-1 to OFF-n. The heat outputs P-1 to P-n to the heaters 3-1 to 3-n are thus controlled.

FIG. 4 shows a relation between a remaining gas volume and a timing chart of the heating control signal outputs S-1 to S-n outputted to the heat output units 6-1 to 6-n from the temperature controllers 5-1 to 5-n, the stop signals OFF-1 to OFF-n as a result of the judgment in the processor/comparator 7 to interrupt (stop) the heat outputs P-1 to P-n from the heat output units 6-1 to 6-n and the heat outputs P-1 to P-n, which are interrupted (stopped) in response to the stop signals OFF-1 to OFF-n, outputted to the heaters 3-1 to 3-n from the heat output units 6-1 to 6-n.

According to a conventional method, every container is controlled merely by the temperature controllers 5-1 to 5-n to keep the temperature measured by the heat sensors 4-1 to 4-n at a determined value. In other words, the control is done one by one (i.e., individually independently from one to another wherein actual liquefied gas temperatures in the containers become slightly different from one another. Therefore, the gas vaporized from a container of higher temperature is recondensed in a container of lower temperature (liquefied gas transportation) or the gas in a container of higher temperature is consumed faster (imbalanced consumption) when the gas is supplied.

In contrast, according to example 1 of the present invention, the weights of the liquefied gas remaining in the containers are measured (monitored) by the weight detectors 2-1 to 2-n at all times, and when the remaining liquefied gas volume (weight) becomes smaller than some value which is obtained by processing all of the measured values totally (mean value in example 1) by a predetermined value D or more, the heating of the container is forcively stopped and the evaporation of the liquefied gas is suppressed. The process is repeated at regular intervals and the heating is stopped during the interval for measuring/comparing as necessary.

In the case of FIG. 4, the remaining volume in the container 1-1 is the least, and therefore the stop signal output OFF-1 is frequently outputted. The gas consumption of the container 1-2 is less and the stop signal output OFF-2 is not outputted, to the contrary. The remaining liquefied gas volume in the container 1-n is slightly less than the average value and the frequency of the stop signal output OFF-n is fewer than OFF-1.

As described above, the remaining liquefied gas volume in each container is compared with the average value and heating of containers whose consumptions are larger than average are stopped forcively by compulsion. Thus all of the liquefied gas 10-1 to 10-n in the containers 1-1 to 1-n decrease uniformly without imbalanced consumption to the end. Therefore, a necessary vaporization capacity at a predetermined temperature can be maintained from the beginning of a supply of the liquefied gas to the end because all of the gas is consumed uniformly and a necessary vaporization surface area is decreased under uniformly maintaining the required vaporization surface area by keeping connections between all of the containers.

The capacity of each container is assumed to be the same in example 1; however, it is not necessary. However, the average value of the remaining gas volume (weight) cannot be used as a standard value. In such a case, a ratio of the remaining gas volume in the container concerned to the whole capacity of the container is calculated for each container and an average value of the ratios can be used as a standard value, for example.

Cubic contents (volume) can be used as a volume of the liquefied gas instead of weights. The present invention can be carried out by substituting cubic contents for weights in example 1.

EXAMPLE 2

Figure 5:
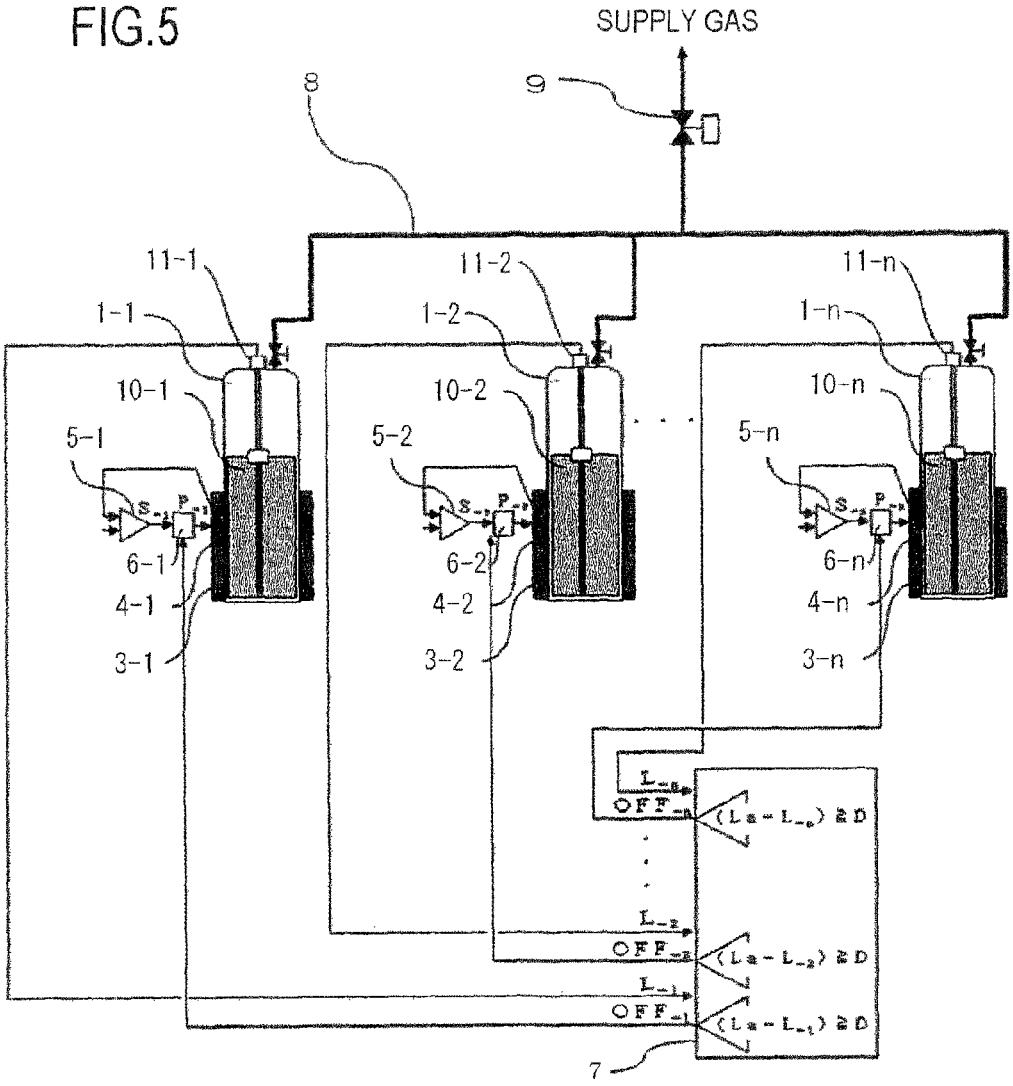
FIG. 5 shows a structure of an example 2 of the liquefied gas supply system of the present invention.

FIG. 5 shows a structure of example 2 of the liquefied gas supply system of the present invention. The system has liquid level sensors 11-1 to 11-n to detect levels of the liquefied gas in the containers as measurement means for remaining gas volume instead of the weight detectors 2-1 to 2-n in FIG. 1. Measured values of the liquid level sensors 11-1 to 11-n are denoted as L-1 to L-n instead of the measured values of the weight detectors 2-1 to 2-n in FIG. 2 and an averaged value of the L-1 to L-n calculated in the processor/comparator 7 is denoted as La. The predetermined value used as a threshold (comparative) value in the processor/comparator 7 is denoted as D and the stop signals outputted by the processor/comparator 7 as a result of the comparison are denoted as OFF-1 to OFF-n in FIG. 5. The liquid level sensors in FIG. 5 are shown as float-type sensors; however, ultrasonic level sensors (non-contacting sensors) or level sensors using radiation can be available.

Example 2 will be explained with reference to FIG. 5. The level in each of the containers is measured by the liquid level sensors 11-1 to 11-*n* continuously as a volume of the liquefied gas in the container and the measured values L-1 to L-n are transmitted to the processor/comparator of measured values 7. The processor/comparator 7 calculates an averaged value La of the measured values L-1 to L-n and differences (La–L-1 to La–L-n) between the average value La and each of the measured values L-1 to L-n. When the difference is larger than or equal to a predetermined value D, the stop signals OFF-1 to OFF-n are outputted from the processor/comparator 7 to the heat output units 6-1 to 6-n of the defined containers. After that the operation is the same as explained in FIGS. 3 and 4, substituting La for Wa and L-1 to L-n for W-1 to W-n.

The remaining volume of the liquefied gas is detected by the liquid level sensor directly in example 2. The direct measurement of the liquid level has less interference than detecting the weight of the containers, that is, piping connected to the container influences the detection of the weight as example 1, for example. The liquid level measurement has an additional advantage that when remaining weight of the gas differs from each other due to a shape or a cross sectional area of the container, it is possible to control the decreasing liquid levels uniformly.

EXAMPLE 3

Figure 6:
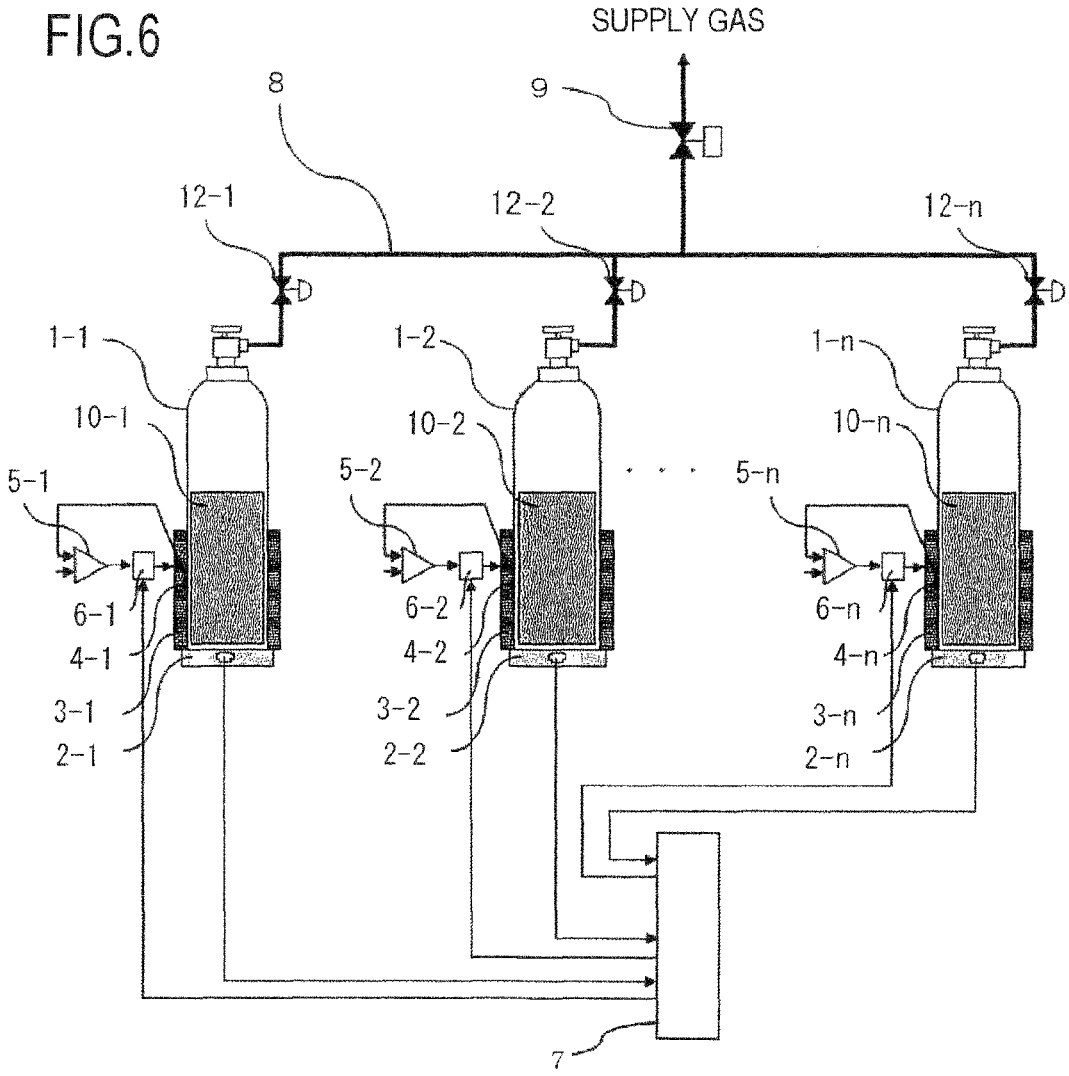
FIG. 6 shows a structure of an example 3 of the liquefied gas supply system of the present invention.
Figure 7:
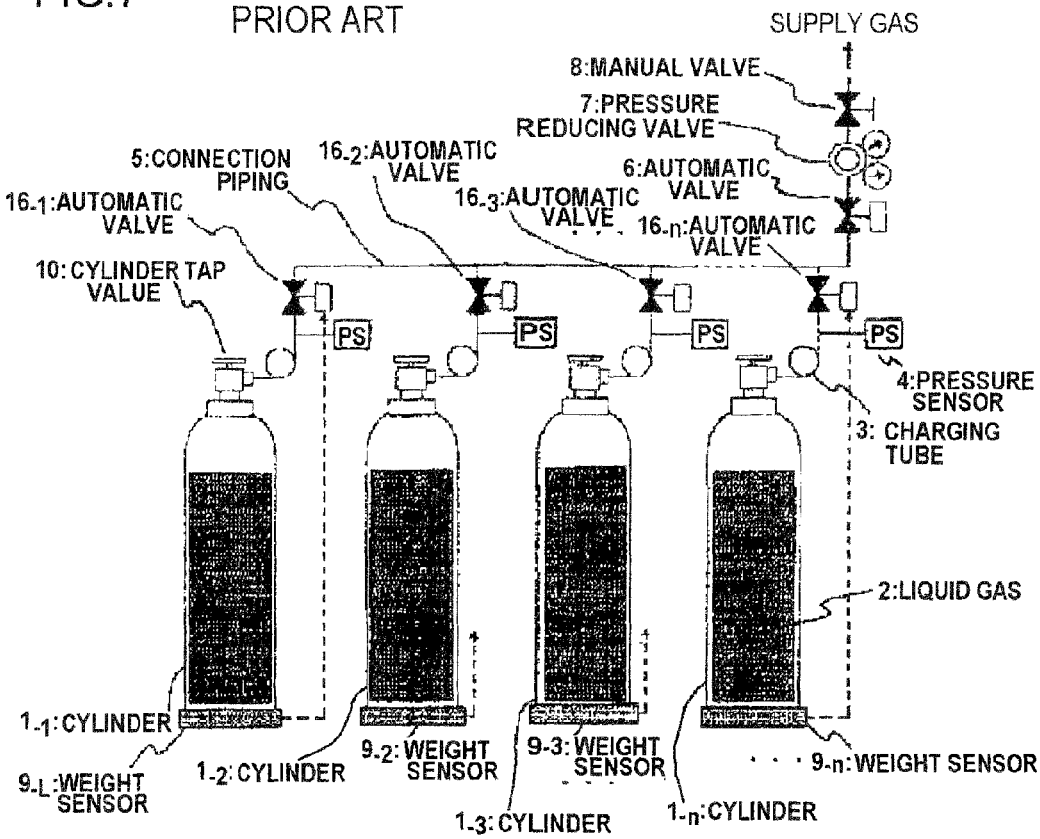
FIG.7 PRIOR ART
FIG. 7 shows an example 1 of a conventional control method of a supply system of liquefied gas.
Figure 8:
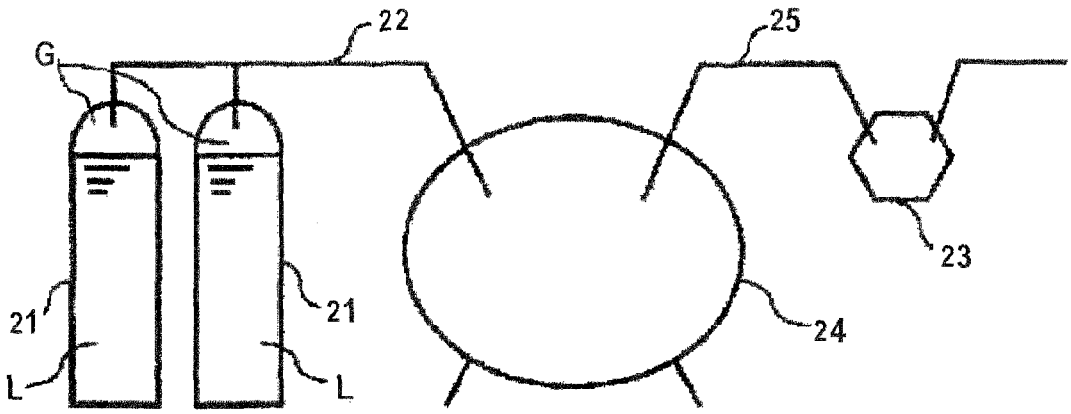
FIG.8 PRIOR ART
FIG. 8 shows an example 2 of a conventional liquefied gas supply system and method.
Figure 9:
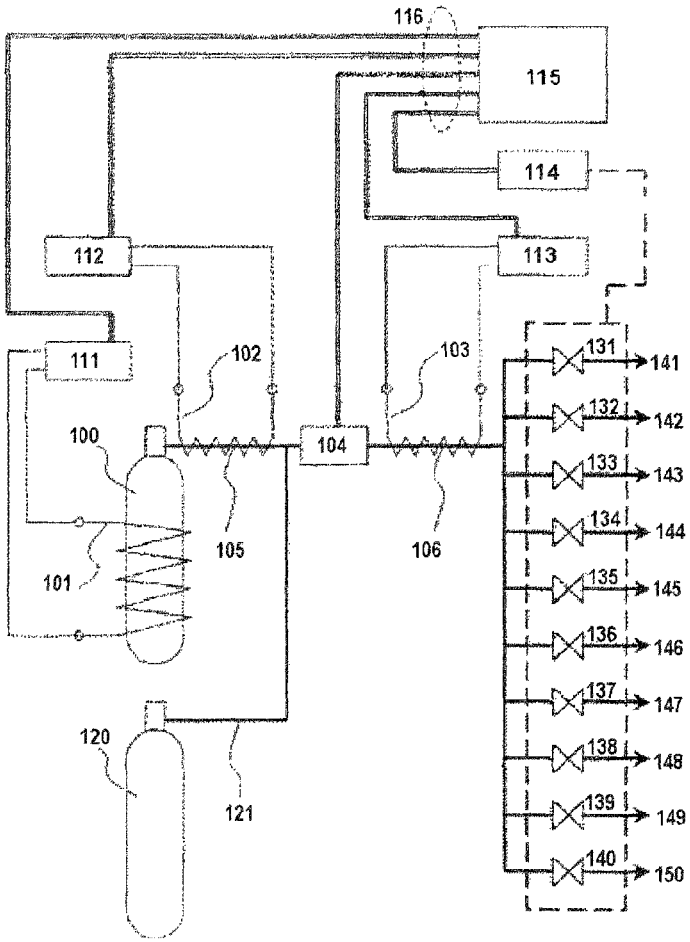
FIG.9 PRIOR ART
FIG. 9 shows an example 3 of a conventional supply method of liquefied gas.
Figure 10:
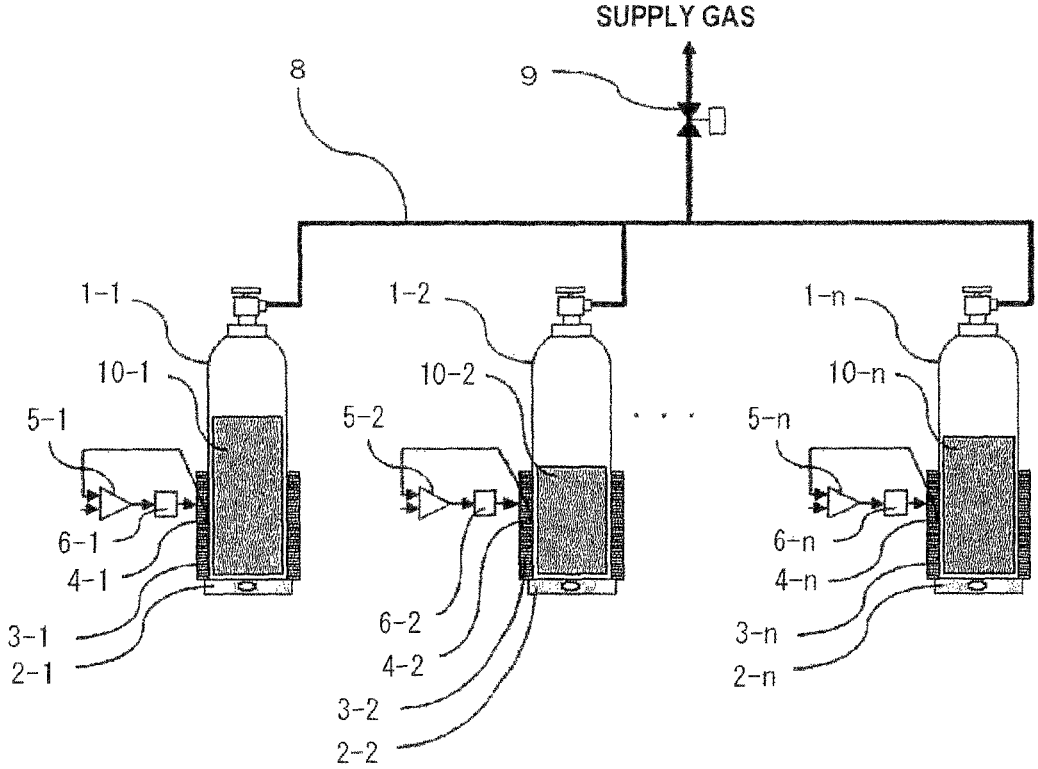
FIG. 10 RELATED ART
FIG. 10 shows an example 4 (related art) of a liquefied gas supply system using a plurality of gas containers.

FIG. 6 shows a structure of example 3 of the liquefied gas supply system of the present invention. The system is formed by adding connection braking valves 12-1 to 12-n to the system shown in FIG. 1.

Example 3 will be explained using FIG. 6. The operation when the gas is supplied is explained in FIGS. 1 and 2. However) the system is not always in the operation state in which all of the containers are connected each other. When gas-consuming processes are out of operation, the vaporized gas supply is stopped or a closing valve 9 is shut off and the gas supply system is under a standby state.

In this situation, the liquefied gas in a container of a higher gas pressure moves to another container of a lower gas pressure due to a small difference in the gas pressure generated by a temperature difference between the two containers (liquefied gas transportation). And the gas volumes in the containers are balanced by the control system of the present invention even in the standby state; however, it is not necessary to balance the volumes in the containers using the control system especially when the closing valve 9 is shut off and the gas is not supplied. Therefore, the connection braking valves 12-1 to 12-n may be closed to shut off connections between the containers temporarily in relation to the closing valve 9. During the connection-braking state, the stop signal outputs OFF-1 to OFF-n are not outputted and the containers are controlled by only the temperature controllers 5-1 to 5-n.

If the processor/comparator 7 failed and the stop signal output was not outputted or the heaters 3-1 to 3-n became out of order when the liquefied gas supply system is under standby state with a full volume of the gas, there is a risk that the liquefied gas may overflow from a container of lower temperature by the transportation of the liquefied gas due to the temperature difference between containers. The system shown in example 3 can eliminate this risk by shutting off the connections between containers by closing the connection braking valves 12-1 to 12-n.

It should be noted that other objects, features and aspects of the present invention will become apparent in the entire disclosure and that modifications may be done without departing the gist and scope of the present invention as disclosed herein and claimed as appended herewith. Also it should be noted that any combination of the disclosed and/or claimed elements, matters and/or items may fall under the modification aforementioned.

What is claimed is:

1. A liquefied gas supply system, comprising:

a plurality of liquefied gas containers, wherein the gas containers are in fluid connection with each other, each of the containers in fluid connection with each other via piping, the piping connecting the liquefied gas containers with a common gas supply line for transporting gas from the containers;

a detector, installed in each of the containers, that detects a volume of liquefied gas contained in each of the containers;

a heating device installed on each of the containers; and a control device that processes information obtained by each of the detectors and controls each of the heating devices, wherein, for each of the liquefied gas containers, the control device controls the heating device so that a liquefied gas supply of the liquefied gas supply system is to be consumed uniformly, the control device controlling each of the heating devices based on a value obtained by a comprehensive processing of the information obtained from all of the detectors so that a supply of liquefied gas within each of the containers is consumed uniformly as the liquefied gas of the containers evaporates into output gas to be transmitted through the supply line, wherein each of the detectors comprises a weight detector of the liquefied gas, wherein said value is an average weight obtained by averaging detected weights of the liquefied gas in each of the containers, and wherein said control device controls each of the heating devices so that a difference between a detected weight of one of the containers and the average weight becomes smaller than a predetermined value.

2. A liquefied gas supply system, comprising:

a plurality of liquefied gas containers, wherein the gas containers are in fluid connection with each other, each of the containers in fluid connection with each other via piping, the piping connecting the liquefied gas containers with a common gas supply line for transporting gas from the containers;

a detector, installed in each of the containers, that detects a volume of liquefied gas contained in each of the containers;

a heating device installed on each of the containers;

a control device that processes information obtained by each of the detectors and controls each of the heating devices, wherein, for each of the gas containers, the control device controls the heating device so that a liquefied gas supply of the liquefied gas supply system is to be consumed uniformly, the control device controlling each of the heating devices based on a value obtained by a comprehensive processing of the information obtained from all of the detectors so that an amount of liquefied gas within each of the containers is consumed uniformly as the liquefied gas of the containers evaporates into output gas to be transmitted through the supply line, wherein each of the detectors comprises a level detector of the liquefied gas, wherein said value is an average level obtained by averaging detected levels of the liquefied gas in each of the containers, and wherein said control device controls each of the heating devices so that a difference between a detected level of one of the containers and the average level becomes smaller than a predetermined value.

3. A liquefied gas supply method, comprising:

supplying a gas from a plurality of liquefied gas containers in fluid connection with each other via a common supply line, a heating device and a detector installed on each of the liquefied gas containers, using a processed information obtained from the detectors to detect a volume of liquefied gas in each of the liquefied gas containers; and controlling each of the heating devices based on a value obtained by a comprehensive processing of information obtained from all of the detectors so that a supply of liquefied gas within each of the liquefied gas containers is consumed uniformly as the liquefied gas of the liquefied gas containers evaporates into output gas that is transmitted through the supply line, wherein each of the detectors comprises a weight detector of the liquefied gas, wherein said value is an average weight obtained by averaging detected weights of the liquefied gas in each of the liquefied gas containers, and wherein each of the heating devices are controlled so that a difference between a detected weight of one of the liquefied gas containers and the average weight becomes smaller than a predetermined value.

4. A liquefied gas supply method, comprising:

supplying a gas from a plurality of liquefied gas containers in fluid connection with each other via a common supply line, a heating device and a detector installed on each of the liquefied gas containers, using a processed information obtained from the detectors to detect a volume of liquefied gas in each of the liquefied gas containers; and controlling each of the heating devices based on a value obtained by a comprehensive processing of information obtained from all of the detectors so that a supply of liquefied gas within each of the liquefied gas liquefied gas containers is consumed uniformly as the liquefied gas of the liquefied gas containers evaporates into output gas that is transmitted through the supply line, wherein each of the detectors comprises a level detector of the liquefied gas, wherein said value is an average level obtained by averaging detected levels of the liquefied gas in each of the liquefied gas containers, and wherein each of the heating devices are controlled so that a difference between a detected level of one of the liquefied gas containers and the average level becomes smaller than a predetermined value.

5. A control device of a liquefied gas supply system, comprising:

a control unit that controls heating devices installed on liquefied gas containers configured to be in fluid connection with each other via a common supply line using a processed information obtained from detectors installed on each of the liquefied gas containers to detect a volume of liquefied gas in each of the liquefied gas containers, wherein each of the heating devices is controlled based on a value obtained by a comprehensive processing of information obtained from all of the detectors so that a supply of liquefied gas within each of the liquefied gas containers is consumed uniformly as the liquefied gas of the liquefied gas containers evaporates into output gas that is transmitted through the supply line, wherein each of the detectors comprises a weight detector of the liquefied gas, wherein said value is an average weight obtained by averaging detected weights of the liquefied gas in each of the liquefied gas containers, and wherein said control device controls each of the heating devices so that a difference between a detected weight of one of the liquefied gas containers and the average weight becomes smaller than a predetermined value.

6. A control device of a liquefied gas supply system, comprising:

a control unit that controls heating devices installed on liquefied gas containers configured to be in fluid connection with each other via a common supply line using a processed information obtained from detectors installed on each of the liquefied gas containers to detect a volume of liquefied gas in each of the liquefied gas containers, wherein each of the heating devices is controlled based on a value obtained by a comprehensive processing of information obtained from all of the detectors so that a supply of liquefied gas within each of the liquefied gas containers is consumed uniformly as the liquefied gas of the liquefied gas containers evaporates into output gas that is transmitted through the supply line, wherein each of the detectors comprises a level detector of the liquefied gas, wherein said value is an average level obtained by averaging detected levels of the liquefied gas in each of the liquefied gas containers, and wherein said control device controls each of the heating devices so that a difference between a detected level of one of the liquefied gas containers and the average level becomes smaller than a predetermined value.

7. The liquefied gas supply system according to claim 1, further comprising:

a connection braking valve to shut off connection lines between the liquefied gas containers in connection with a closing valve to shut off transmission of the gas from the liquefied gas containers.

8. The liquefied gas supply system according to claim 2, further comprising:

a connection braking valve to shut off connection lines between the liquefied gas containers in connection with a closing valve to shut off transmission of the gas from the liquefied gas containers.

* * * * *